US005937620A

United States Patent [19]

Chalendar

[11] Patent Number: 5,937,620

[45] Date of Patent: Aug. 17, 1999

[54] PACKAGING MACHINE FOR MULTI-PACKS

[75] Inventor: Eric Chalendar, Chateauroux, France

[73] Assignee: The Mead Corporation, Dayton, Ohio

[21] Appl. No.: 08/932,421

[22] Filed: Sep. 17, 1997

Related U.S. Application Data

[63] Continuation of application No. PCT/US96/04052, Mar. 26, 1996.

[30] Foreign Application Priority Data

Mar. 3, 1995 [GB] United Kingdom ..... 9506541

[51] Int. Cl.[6] ..... B65B 43/52

[52] U.S. Cl. ..... 53/566; 53/168; 53/201; 53/251; 53/543

[58] Field of Search ..... 53/168, 201, 250, 53/251, 252, 448, 458, 543, 566, 579; 198/419.3

[56] References Cited

U.S. PATENT DOCUMENTS

| | | | |
|---|---|---|---|
| 3,325,977 | 6/1967 | Kirsten | 53/201 X |
| 3,509,681 | 5/1970 | Sass | 53/252 X |
| 4,180,154 | 12/1979 | Andersson . | |
| 4,718,540 | 1/1988 | Greenwell . | |
| 4,768,642 | 9/1988 | Hunter . | |
| 5,044,876 | 9/1991 | Stohlquist . | |
| 5,127,209 | 7/1992 | Hunter . | |
| 5,145,053 | 9/1992 | Krieger et al. . | |
| 5,241,806 | 9/1993 | Ziegler et al. | 53/252 X |
| 5,282,530 | 2/1994 | Neri . | |
| 5,339,599 | 8/1994 | Risnes | 53/252 |
| 5,355,658 | 10/1994 | Thiede | 53/566 |
| 5,407,059 | 4/1995 | Fochler . | |
| 5,546,734 | 8/1996 | Moncrief et al. | 53/566 X |

FOREIGN PATENT DOCUMENTS

| | | |
|---|---|---|
| 0 623 514 A1 | 11/1994 | European Pat. Off. . |
| 2 256 627 | 12/1992 | United Kingdom . |

*Primary Examiner*—Daniel B. Moon
*Attorney, Agent, or Firm*—Thomas A. Boshinski

[57] ABSTRACT

A packaging machine for packaging articles into cartons has a carton conveyor including an endless series of carton conveying elements in which adjacent carton conveying elements are carried in similar but independent first and second endless series, the first endless series being adjustable relative to the second endless series so that the spacing between adjacent conveying elements can be varied in accordance with the size of a carton to be processed through the machine, the first and second endless series being adapted to operate in synchronism during processing of cartons through the machine.

9 Claims, 11 Drawing Sheets

PACKAGING MACHINE FOR MULTI-PACKS

RELATED APPLICATION

This is a continuation of PCT International Application PCT/US96/04052 filed Mar. 26, 1996.

BACKGROUND OF THE INVENTION

This invention relates to a packaging machine which is especially suitable for processing multipacks of articles such as beverage containers from blank form to completed filled cartons. The machine is readily adjustable to accommodate a wide range of carton sizes without undue time being taken to adapt the machine from running one size of carton to running a different size of carton.

SUMMARY OF THE INVENTION

In accordance with the present invention, a packaging machine is provided for packaging articles such as beverage containers or the like into cartons, having a carton conveyor including an endless series of carton conveying elements in which adjacent carton conveying elements are carried in similar but independent first and second endless series, the first endless series being adjustable relative to the second endless series so that the spacing between adjacent conveying elements can be varied in accordance with the size of a carton to be processed through the machine, the first and second endless series being adapted to operate in synchronism during processing of cartons through the machine.

DETAILED DESCRIPTION OF THE PREFERRED EMBODIMENT

Figure 1:
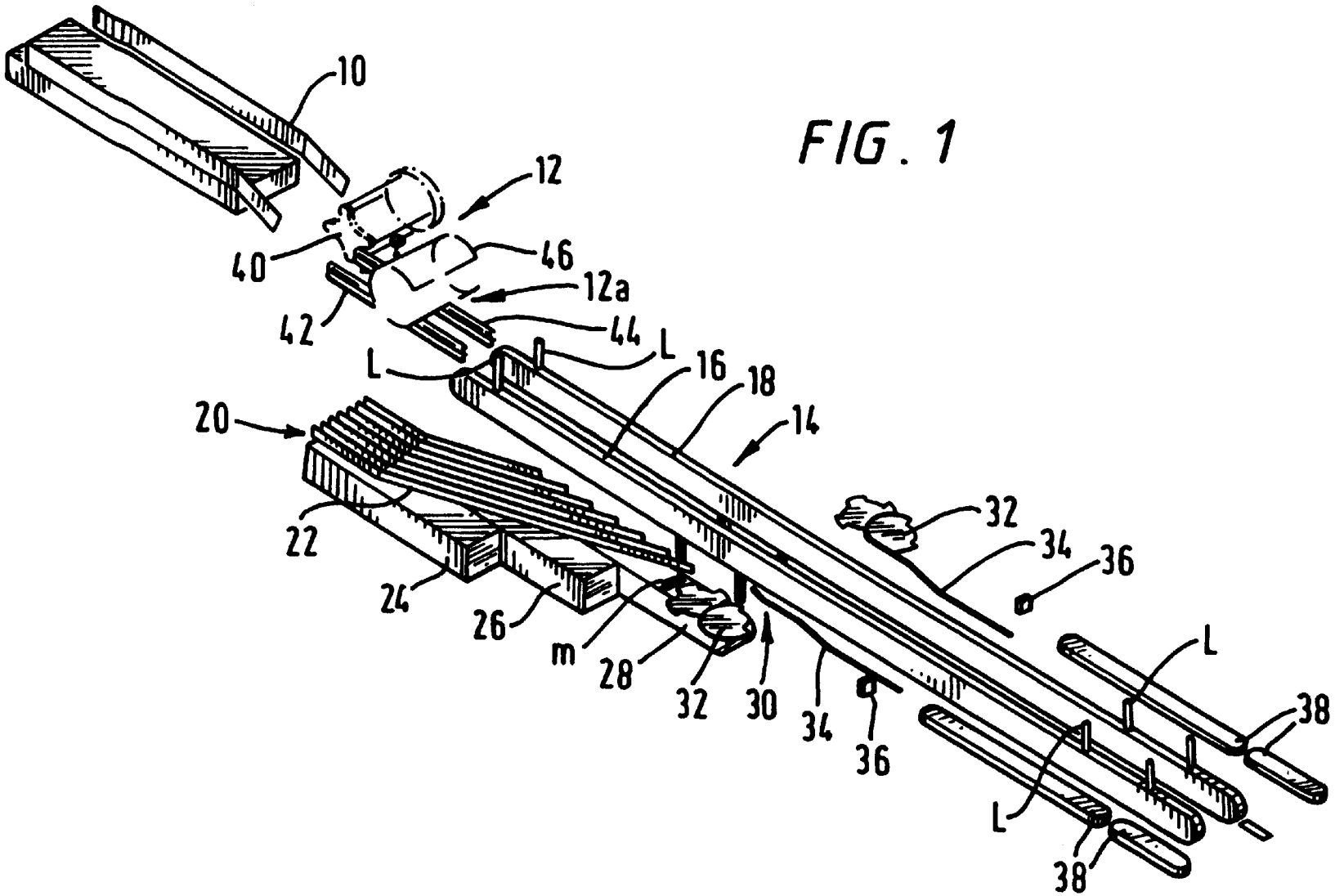
FIG. 1 is a general schematic layout of a packaging machine according to the invention.

Referring to the drawings, FIG. 1 shows a machine according to the invention in schematic form for erecting cartons and filling the cartons with articles such as beverage cans, bottles and the like. The machine comprises, in series, a hopper 10 adjacent to infeed end of the machine, in which carton blanks to be processed through the machine are stored and fed to a feeding and erecting station 12, 12*a* at the infeed end of the machine.

The main carton conveying and filling line 14 of the machine comprises a pair of spaced side by side main parallel lug chain assemblies 16, 18 each of which includes a pair of endless lug chains 16*a*, 16*b* and 18*a*, 18*b* respectively, which carry an endless series of carton conveying lugs 'L'. The lugs of one chain are adjustable with respect to the lugs on the adjacent chain so that the distance between the lugs on one chain from those of the lugs on the second chain of the pair can be adjusted depending upon the size (breadth) of carton to be conveyed. Adjustment is described in more detail with reference to FIGS. 11 and 12.

An article infeed assembly 20 is provided alongside the upstream end of one of the lug chain assemblies 16 and comprises a series of guides 22 which converge towards the conveying and filling line 14, a series of infeed conveyers 24 and 26, and an article group-forming conveyor 28 by means of which the cans to be loaded into cartons processed along the conveying and filling line 14 by the lug chain assemblies are directed towards the open ends of the carton. In general terms, the particular technique by which the beverage cans are grouped or metered within the divergent guides as they pass across the infeed conveyors is known from EP 0 017 333 although the particular metering elements and their operation in the present machine have not hitherto been disclosed.

Figure 2:
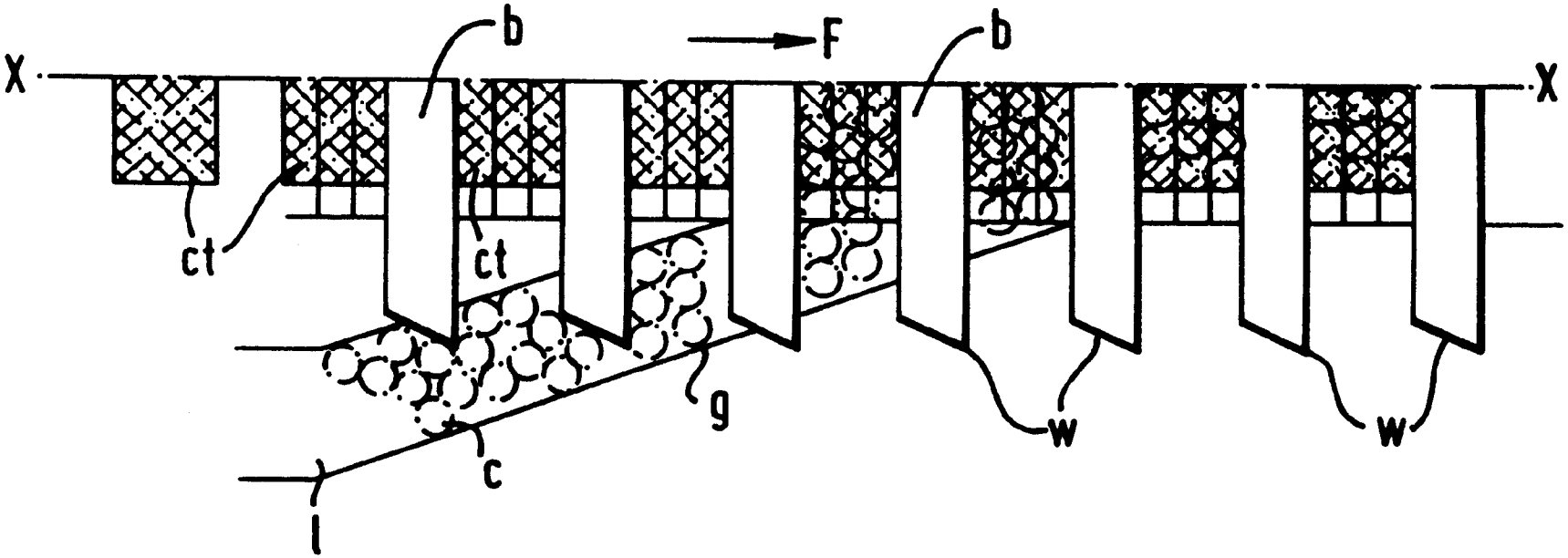
FIG. 2 is a schematic plan view of a known article metering system for end-loading cartons.
Figure 3:
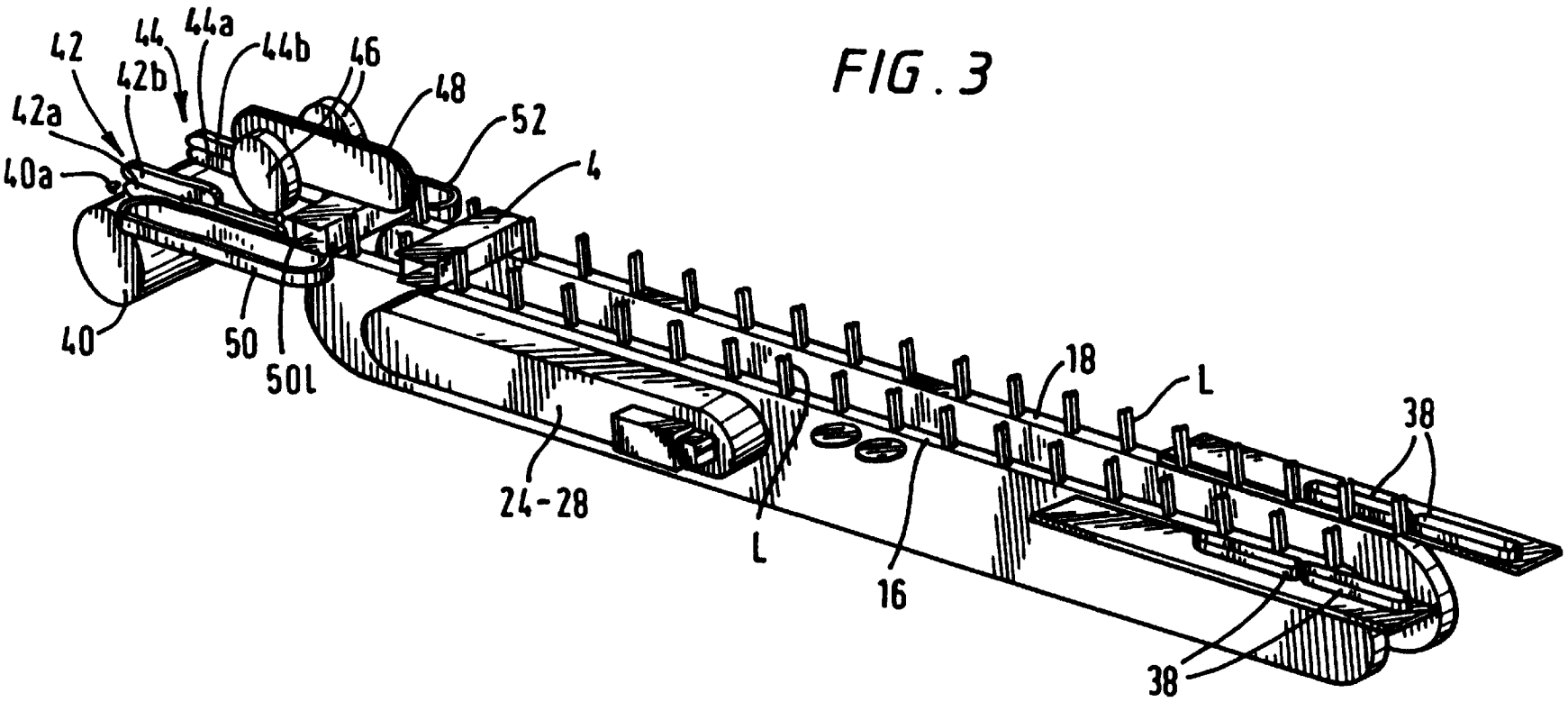
FIG. 3 is a schematic perspective view showing further detail of the machine shown generally in FIG. 1.
Figure 4:
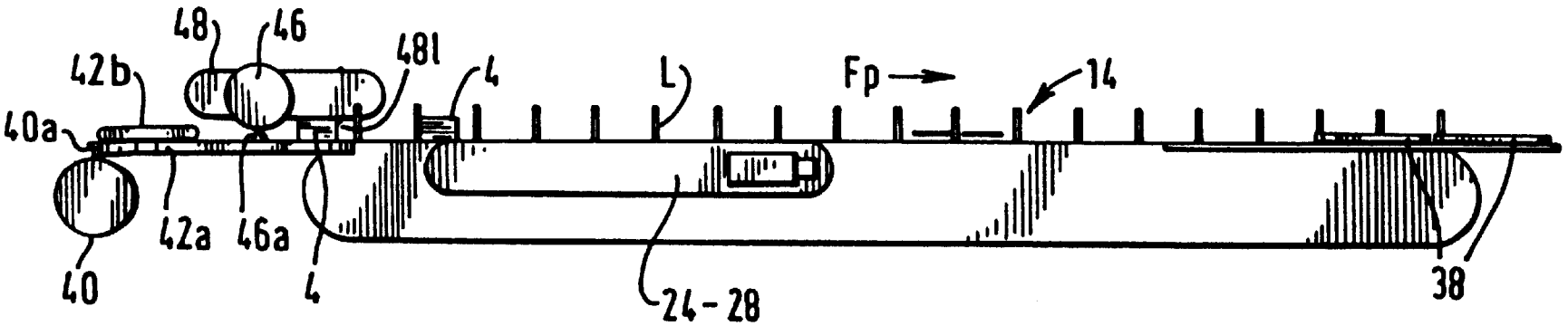
FIG. 4 is a side elevation of the machine shown in FIG. 3.
Figure 5:
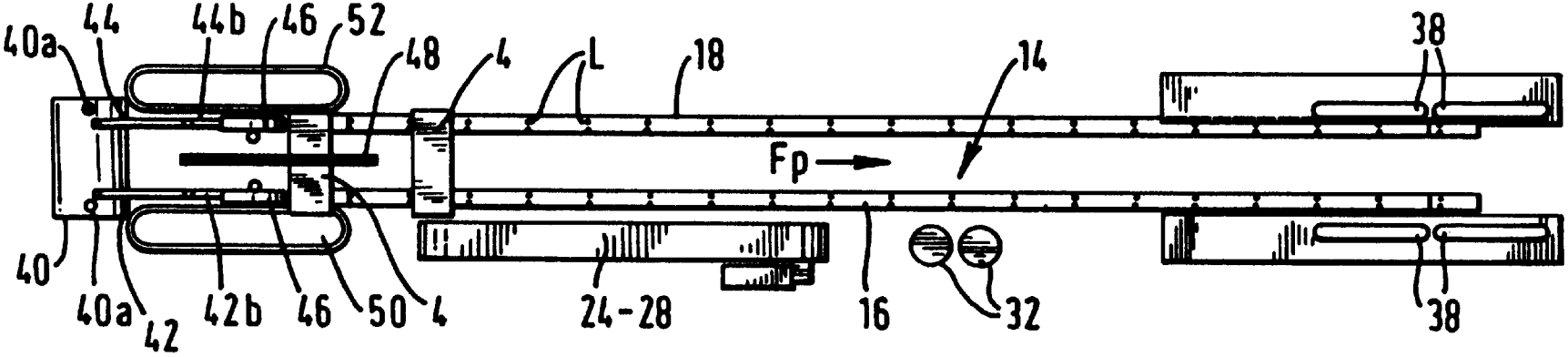
FIG. 5 is a top plan view of the machine shown in FIG. 3.
Figure 6:
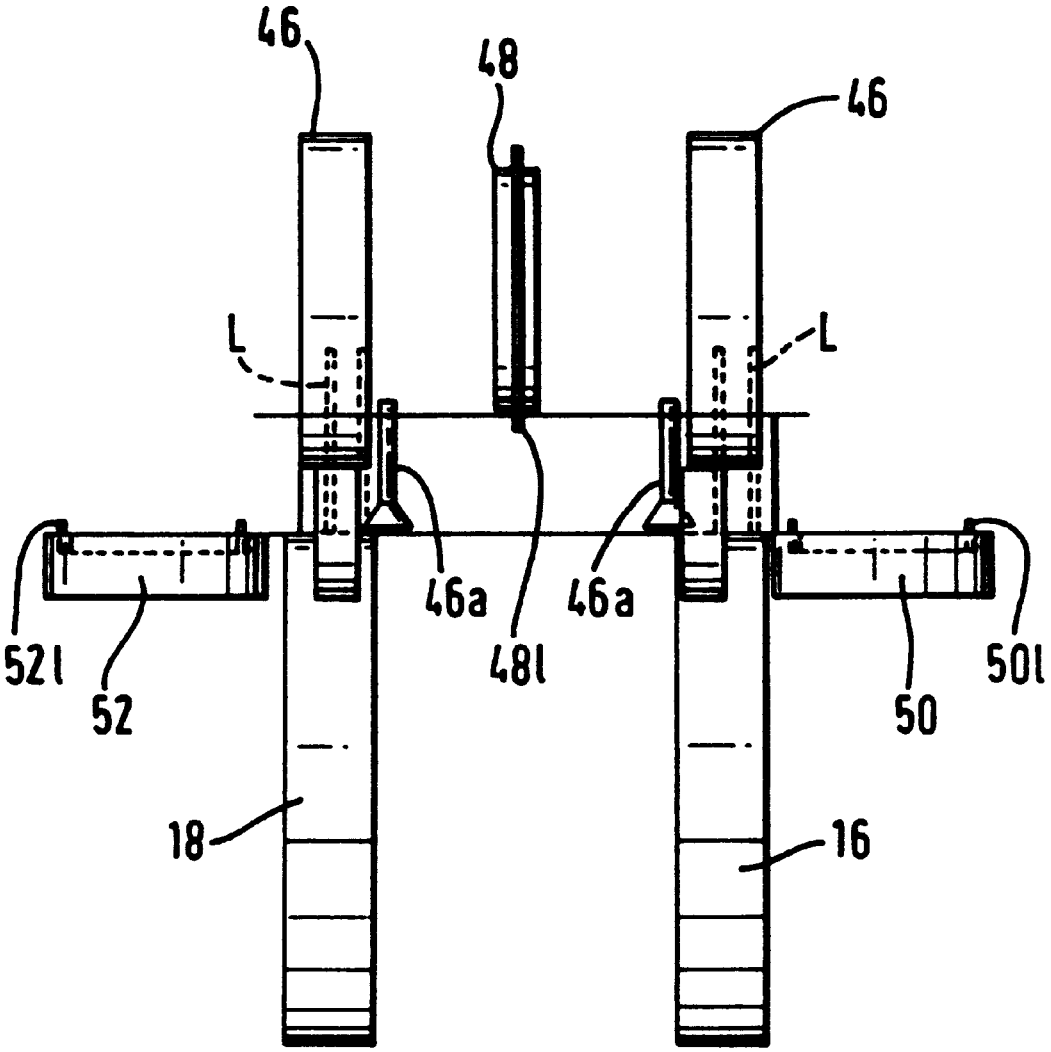
FIG. 6 is an end elevation as seen from the infeed end of the machine shown in FIG. 3.

The metering or grouping function is achieved by an endless series of metering bars 'm', described in more detail with reference to FIGS. 7 to 10 and which interrupt the infeed path of the articles within the convergent guides alongside the adjacent lug chain assembly 16 to group and ultimately to cause the articles to be end-loaded into the cartons passing along the line 14. A packaging machine which incorporates metering bars which extend across the full width of a carton conveying and filling line of a packaging machine is disclosed in the aforesaid European Patent 0 017 333. However, by way of illustration, the metering function of such metering bars is considered more specifically with reference to FIG. 2. FIG. 2 shows, schematically, the function of metering bars to end-load groups of cans 'c' into a series of cartons. The cartons 'ct' are held between and conveyed by an endless series of metering bars 'b' moving over a support platform 'p'. The cans 'c' are conveyed towards the carton feed path 'f' with convergent guides 'g'. The metering bars 'b' have wedge-shaped ends 'w' which gradually enter the can infeed line 'l' so as to create a metered group of cans, in this illustration six cans, for loading. Ultimately, the forward movement of the metering bars in the feed direction 'f' in conjunction with the convergent guides 'g' causes each group of cans so metered to be corralled into the open end of an adjacent carton 'ct'. A similar mirror image arrangement exists on the opposite side of the centre line x—x in which the metering bars extend across the feed path. However, in the present machine the cartons are conveyed not by metering bars but by the lug chain assemblies or at least one of them with the endless series of metering bars operating alongside one or perhaps both of the lug chain assemblies as described later.

Downstream of the loading station the machine comprises an end flap closing station 30 which includes rotatable closure wheels 32 and fixed end flap closure guides 34. A gluing station 36 is provided adjacent the downstream end of the end flap closing station followed by end flap side compression belts 38 which hold the glued end flaps together while the glue applied at station 36 sets.

A machine according to present invention is adjustable in a number of respects so as to be able to process cartons containing numerous configurations of groups of cans to create a range of carton size from a 4-can carton (2×2) to a 30-can carton (6×5) without undue amounts of downtime being spent in adjusting the machine. Indeed, the machine can be readily adapted to process cartons to produce a wide range of cartons having numerous can group configurations.

The specific significant elements of the machine are now described in more detail.

Referring first to FIGS. 3, 4, 5 and 6 of the drawings, at the infeed end of the machine the feeder assembly 12 comprises a rotary feeder 40 provided with an annular series of vacuum cups 40*a* positioned beneath the feed path 'fp' of cartons to be processed through the machine. Feeder 40 is located adjacent a pair of parallel side by side carton blank transfer belt assemblies 42 and 44. The feeder 40 collects successive single cartons from the hopper supply 10 and transfers them into a horizontal position in which they are taken up between the transfer belt assemblies and moved downstream towards the carton opening assembly 12*a* in the feed direction of the machine. The lowermost belts 42*a* and 44*a* of each of the carton transfer belt assemblies are constructed as vacuum belts so that as the carton leaves the nip between the upper belts 42*b*, 44*b* and the lower belts 42*a*, 44*a*, it is retained in flat collapsed condition against the face of the lower vacuum belts. The carton is moved under the operative paths of a twin overhead rotary carton opening device 46 and an overhead vertically disposed lug chain 48 and into the operative paths of a pair of parallel side lug chain infeed assemblies 50 and 52 respectively.

The twin overhead rotary carton opening device also includes a series of vacuum cups 46*a* which are constrained to face in the direction of the adjacent exposed carton (top) panel and engage that panel so that when vacuum is applied the exposed upper panel is moved upwardly away from the opposed panel which is held against the lower vacuum belts 42*a*, 44*a*. The panel is moved into the path of movement of both the vertical overhead lug chain 48 and the pair of infeed side lug chains 50, 52. The side lug chains operate in a substantially horizontal plane alongside each of the carton transfer and vacuum belt assemblies 42, 44 between which the overhead vertical lug chain 48 is disposed.

The side lug chains 50, 52, the overhead lug chain and the twin overhead rotary opening device 46 are synchronised so that as the opening device 46 initially erects a carton against the resistance of the vacuum belts, it is put into position so that the leading face of that carton (in terms of the feed direction of the machine) is bought to bear against one of the lugs 48*l* in the upper lug chain assembly 48 whereas the trailing face of that carton is engaged by lugs 50*l* and 52*l* carried by the side lug chain assemblies 50, 52. The initial carton set-up by the rotary opening device 46 is such that the loading and trailing faces of the carton hinge against the feed direction, ie. hinge upstream. The speed of the upper lug chain assembly 48 is set to be somewhat slower than the side lug assemblies so that the carton, whilst it is conveyed by both the overhead and side lug assemblies, it is in effect 'squeezed' so that the carton is fully squared up into its fully set up condition ready for loading.

As the carton leaves the downstream end of the overhead and side lug chain assemblies it is engaged against its trailing face by the moving lugs L of the main carton conveying lug chain assemblies 16, 18 (or at least one of those assemblies depending on the size of the carton being processed). For the purpose of this part of the description, it will be assumed that the carton size is such that both the main lug chain assemblies are employed to convey the open ended carton through the machine for loading. End-loading of the cartons is achieved by the cooperation between the can infeed conveyors 24 and 26 and group-forming conveyor 28, the convergent guides 22 and the metering bars 'm' at the article infeed assembly.

Figure 7:
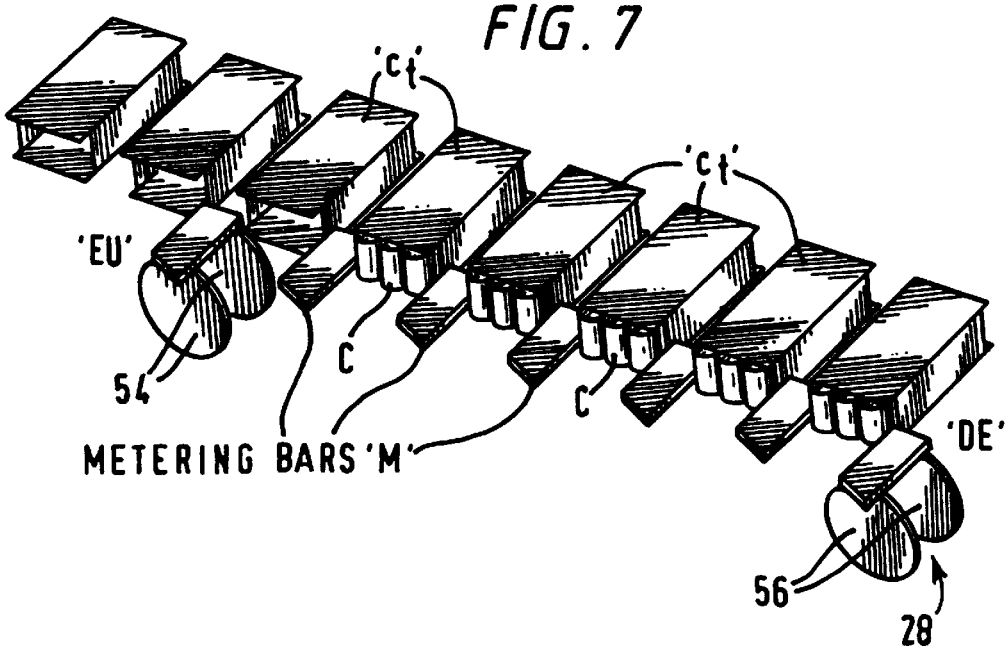
FIG. 7 is a schematic perspective view of the metering and loading section of the machine.
Figure 8:
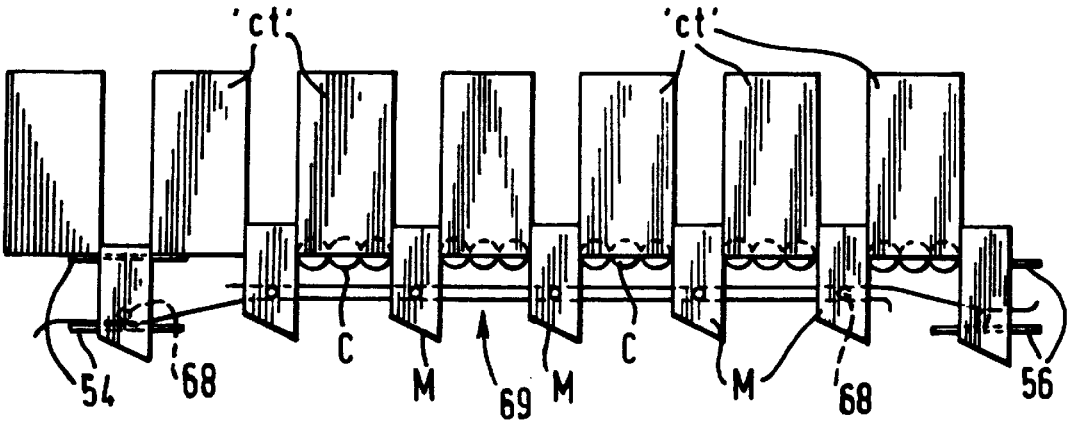
FIG. 8 is a plan view of the arrangement shown in FIG. 7.

Reference is now made to FIGS. 7 and 8 which show schematically the way in which loading of the cans into the open ends of the cartons is achieved. As described with reference to FIG. 2, the technique, in principle, is known in a different metering bar arrangement but which nevertheless involves a series of metering bars gradually to interfere with and pass across an infeed line of cans which are constrained to move between guides which converge towards the carton feed path. As can be seen by reference to FIGS. 7 and 8, in this way the shaped ends of the metering bars 'm' gradually create a group of cans between adjacent bars which, by virtue of the convergent nature of the guides, are corralled into the open ends of the carton disposed alongside adjacent metering bars. In the present embodiment of the invention the metering function is carried out along one side only of the machine and, therefore, an endless series of metering bars is required to move across the convergent guide section 22 of the article infeed section 24–26.

The spacing between adjacent metering bars is dependent upon the size of the cans and the number of cans to be placed into each group. To facilitate adjustments of the machine to load different carton and/or can sizes, the metering bars are detachable as described in detail herein. Thus metering bars 'm' may be removed and/or metering bars of different sizes may be substituted to prepare the machine to package different cans and/or cartons.

To this end, group-forming conveyor 28 includes an endless series of detachable and retractable metering bars 'm' which are carried by two sets of paired chains and sprockets 54, 56. The cartons for loading are carried along the main lug chain assemblies. At the upstream end 'EU' of the metering bar assembly, the bars are required to move around sprockets 54 into operative position with clearance from the immediately adjacent ends of the carton end flaps. However, in order to ensure that the cans 'c' are correctly loaded into the adjacent cartons 'Ct', the inboard ends of the metering bars should be located between adjacent cartons so that the side wall end flaps are properly supported and cans are properly guided. In order to accomplish this, as the metering bars 'm' move downstream together with the cartons 'Ct', the inboard ends of the metering bars are constrained to move inwardly between adjacent cartons by virtue of a cam and follower arrangement 68, 69 until the loading process is complete at the downstream end 'DE' of the assembly, whereafter, the metering bars are gradually brought back into their original position for return upstream in the return path of the metering bar assembly. The specific details of a detachable and retractable flight bar used in this embodiment of the machine is shown in FIGS. 9 and 10 of the drawings, to which reference is now made.

Figure 9:
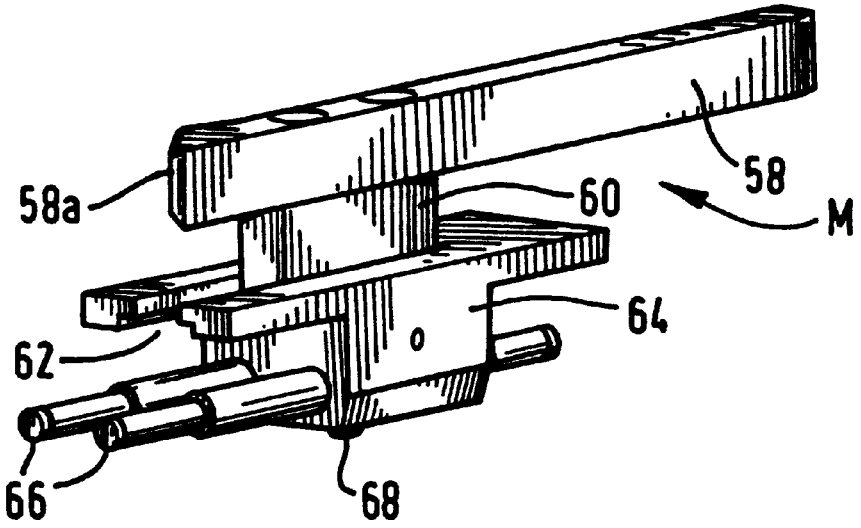
FIGS. 9 and 10 are a first and second perspective views of a metering bar and carrier incorporated in the metering and loading section of the machine.
Figure 10:
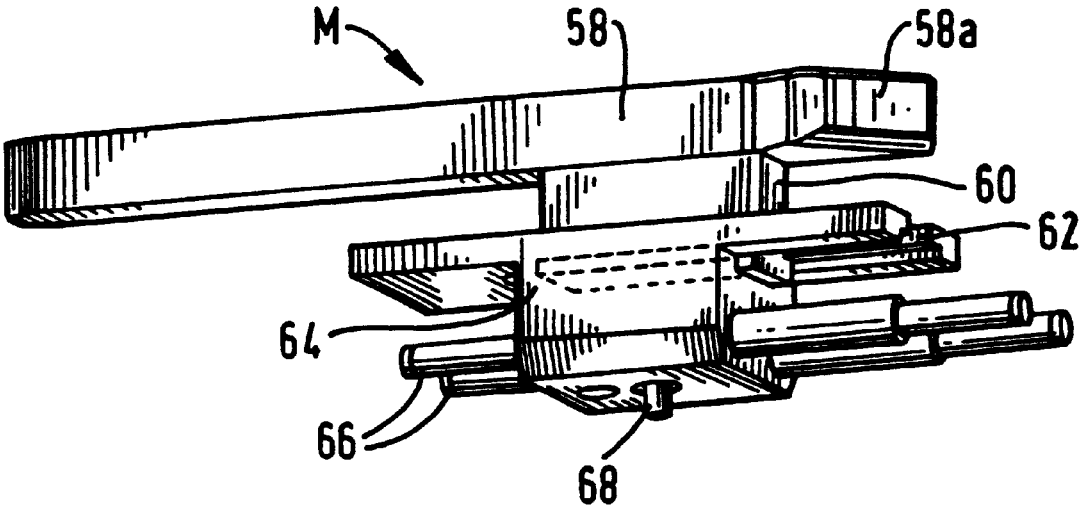

Referring now to FIGS. 9 and 10, details of the retractable and detachable metering bars is shown. Each metering bar 'm' includes a bar element 58 having an outboard wedge-shaped end 58*a* and a downwardly dependent key 60 of substantially T-shaped cross section which engages in a complementary key-way 62 provided in a carrier 64. A series of carriers 64 are mounted along the carrier chain drive, which incorporates the twin chain and sprocket assemblies 54, 56. The carrier includes spring loaded shafts 66 so that the carrier can be resiliently moved transversely of the direction of movement along the carrier chain drive. The base of the carrier includes a cam follower 68 which engages in a suitably shaped cam track 69 (shown schematically in FIG. 8) alongside the carrier chain drive to cause the metering bar unit comprising the carrier and the metering bar itself to move inwardly between a pair of adjacent cartons being processed through the machine during the metering and loading process and, thereafter to be retracted so that the metering bar can return along the return path of the metering bar chain assembly. The metering bar can be readily detached from its carrier by slidingly disengaging the key from the carrier keyway. Such detachment between metering bars and carriers is desirable to adjust the spacing between adjacent bars in accordance with the size (breadth) of carton being processed. Selected ones of the metering bars may be removed or added to adjust machine pitch, while different size metering bars may be substituted to vary the size of the space between adjacent metering bars.

The cartons themselves are conveyed through the machine by means of the lug chain conveying assemblies 16, 18. Each of these assemblies includes a pair of lug chains which are adjustable relative to one another. One such assembly is shown in more detail with reference to FIGS. 11 and 12 which may be assumed to show the arrangement with reference to main lug chain assembly 16. Assembly 18 is of similar construction.

Figure 11:
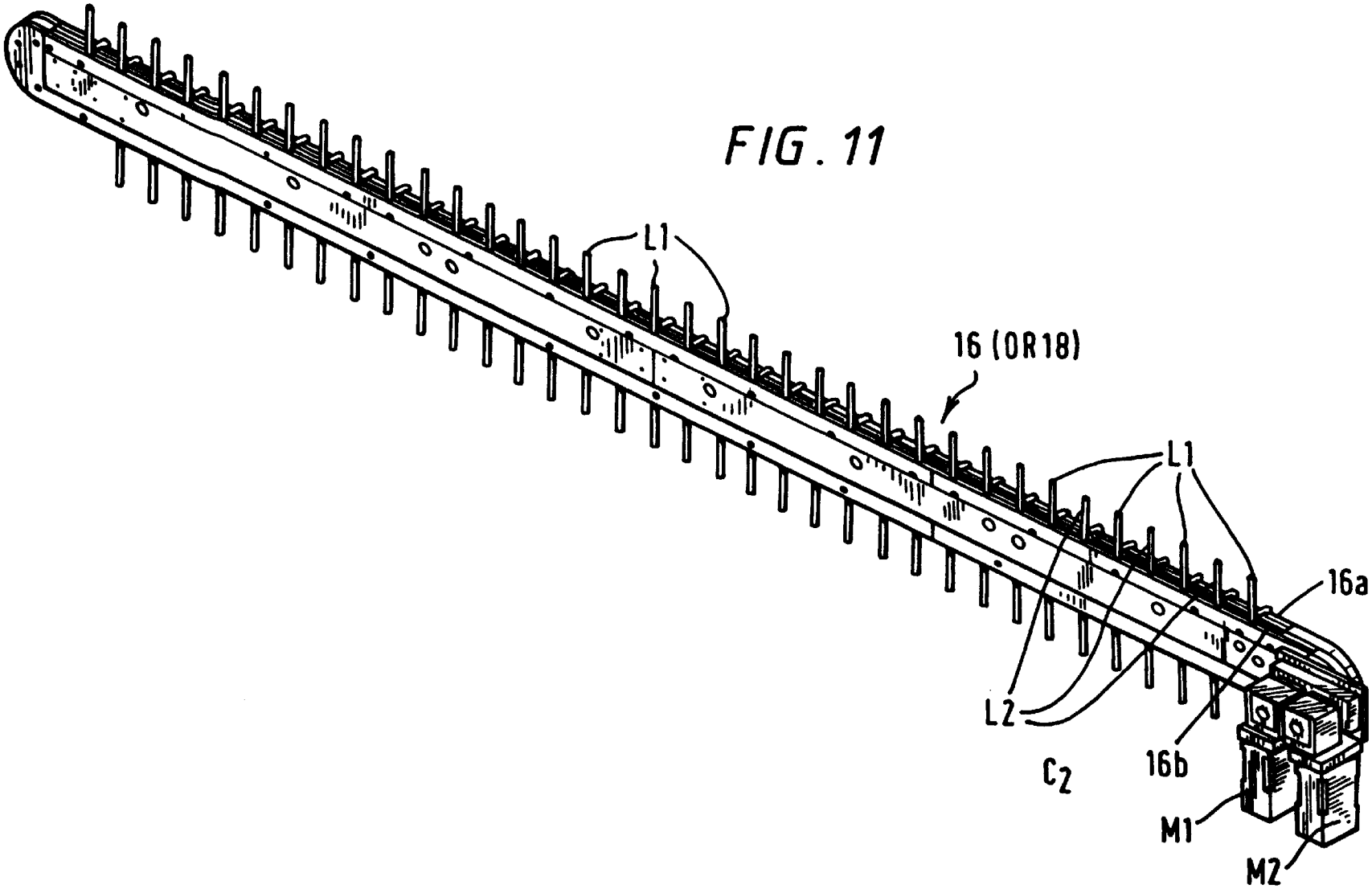
FIG. 11 is a schematic perspective view of one of the main lug chain assemblies of the machine.
Figure 12:
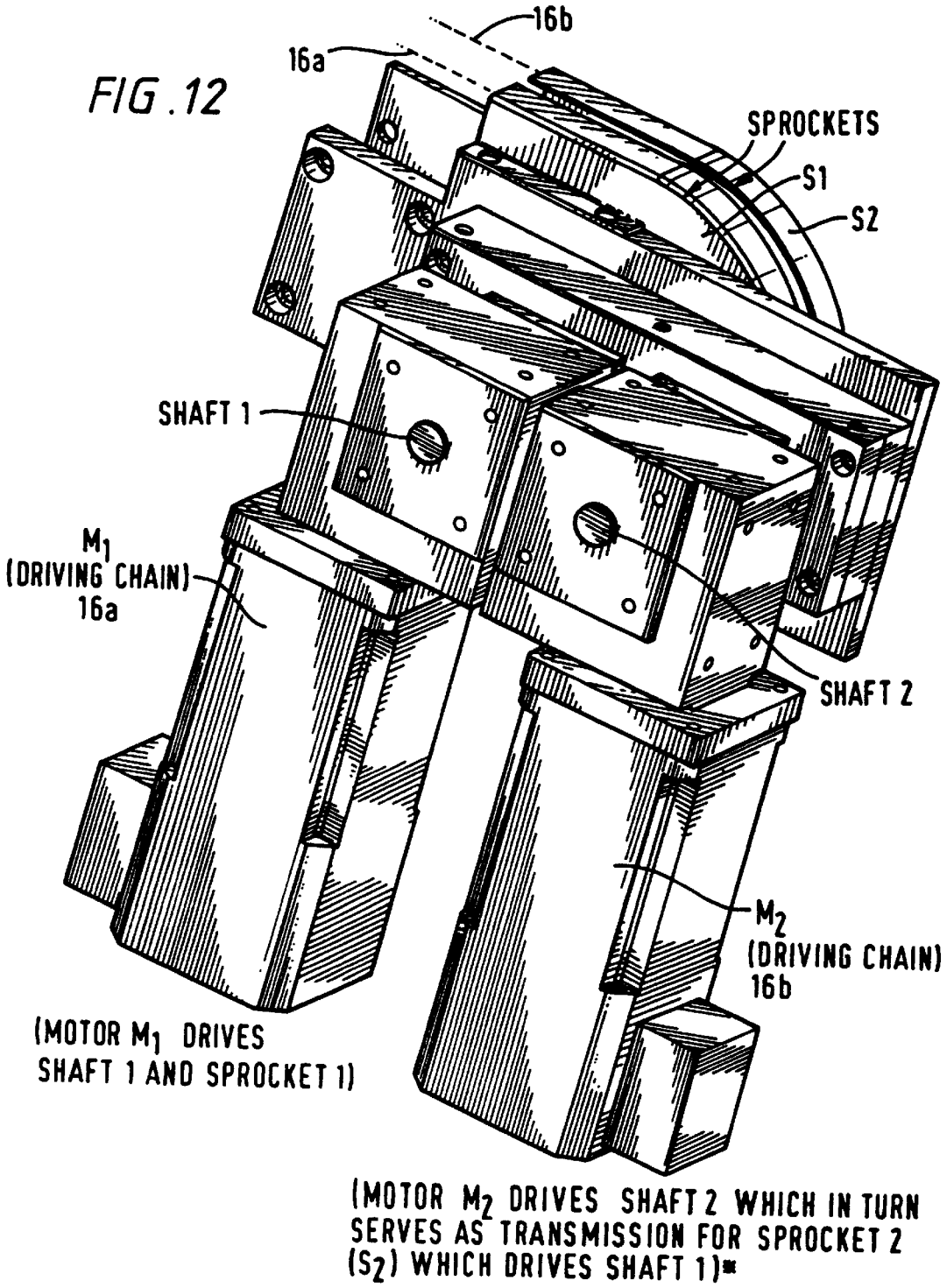
FIG. 12 is a perspective view of the drive and adjustment means of the assembly shown in FIG. 11.

The lugs identified as L1 are driven by lug chain 16*a* and the lugs identified by reference L2 are driven by lug chain 16*b* in the same assembly. Lug chain 16*a* is driven by servo-motor M1 (FIG. 12) and lug chain 16*b* is driven by servo-motor M2. Motor Ml drives shaft 1 and sprocket 1 and motor M2 drives shaft 2 which in turn serves as a transmission for sprocket 2. The two drive sprockets S1 and S2 are disposed on the same shaft. Sprocket S1 is firmly keyed to shaft 1 whereas sprocket S2 is carried by shaft 1 but is rotatable with respect thereto by shaft 2. Sprocket S1 carries lug chain 16*a* and sprocket S2 carries lug chain 16*b*. In FIG. 11 of the drawings, the lug chains are adjusted so that the distance between adjacent lugs L1, L2 is equal and this would be a typical configuration required for a relatively small carton. Larger sized cartons are accommodated when the spacing between the adjacent lugs of the separate chains are minimised. Thus, when the lugs of chain 16*a* are closed up into abutment with the lugs of chain 16*b* then the spacing between successive lug pairs is at a maximum to allow the greatest width carton. Adjustment is carried out by incrementing the servo-motors to move the chains 16*a*, 16*b* relative to one another whereas in normal operation the chains 16*a* and 16*b* are driven in synchronism by the servo-motors. Appropriate control circuitry for the motors (not shown) including a programmable control device is provided to carry out this operation. It will be understood by those skilled in the art how such controls can be constructed and programmed to carry out the operations described herein.

In one example, adjustment of the first series of lugs L1 with respect to the second series of lugs L2 is carried out by moving one of the series by its respective servo-motor M1 or M2 while holding the other of the lug series stationary. Alternatively, adjustment may be carried out by moving one of the lug series by its servo-motor in one direction while moving the other lug series by its servo-motor in the opposite direction.

In order to provide for the adjustability between the main lug chain assemblies 16, 18, as opposed to the adjustability between adjacent lugs within each unit, lug chain assembly 18 remote from the article metering and loading side of the machine is adjustable transversely towards and away from the other assembly 16 alongside the article infeed station which is fixed relative to the article infeed assembly 20.

Figure 13:
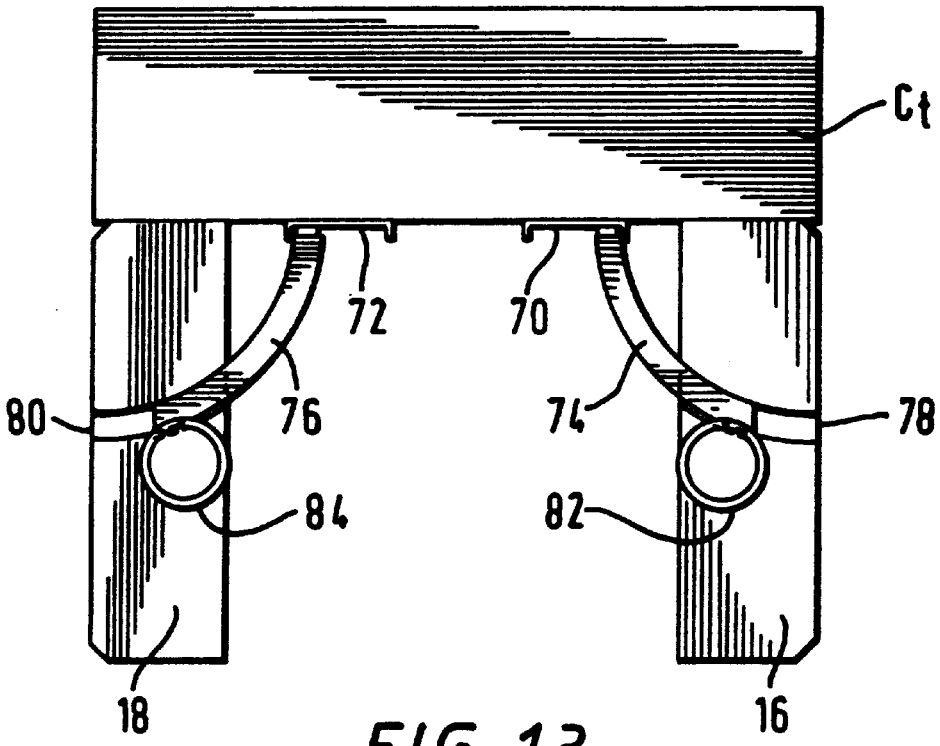
FIG. 13 is a schematic end view of the main lug chain assemblies of the machine adjusted to process a wide carton.
Figure 14:
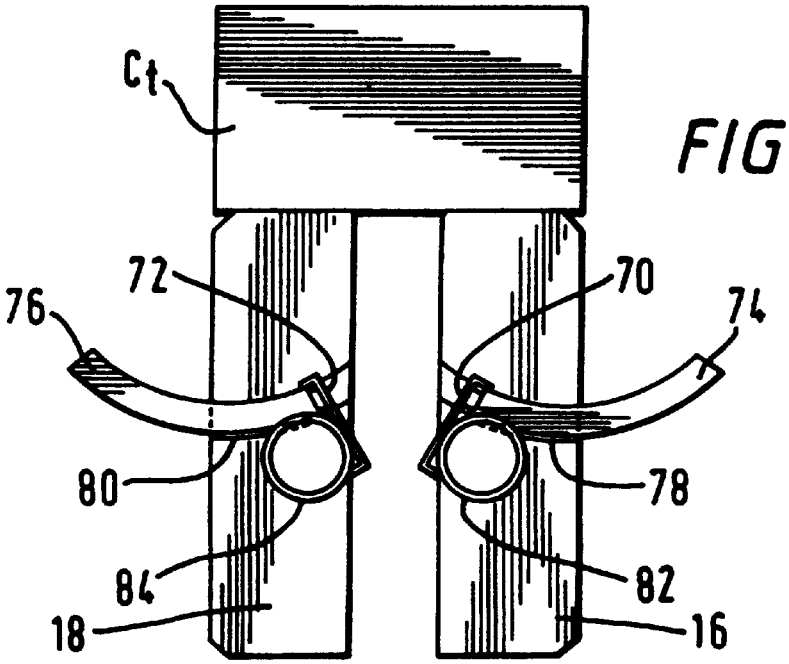
FIG. 14 is a view similar to FIG. 13 but showing the main lug chain assemblies adjusted for a smaller width package.
Figure 15:
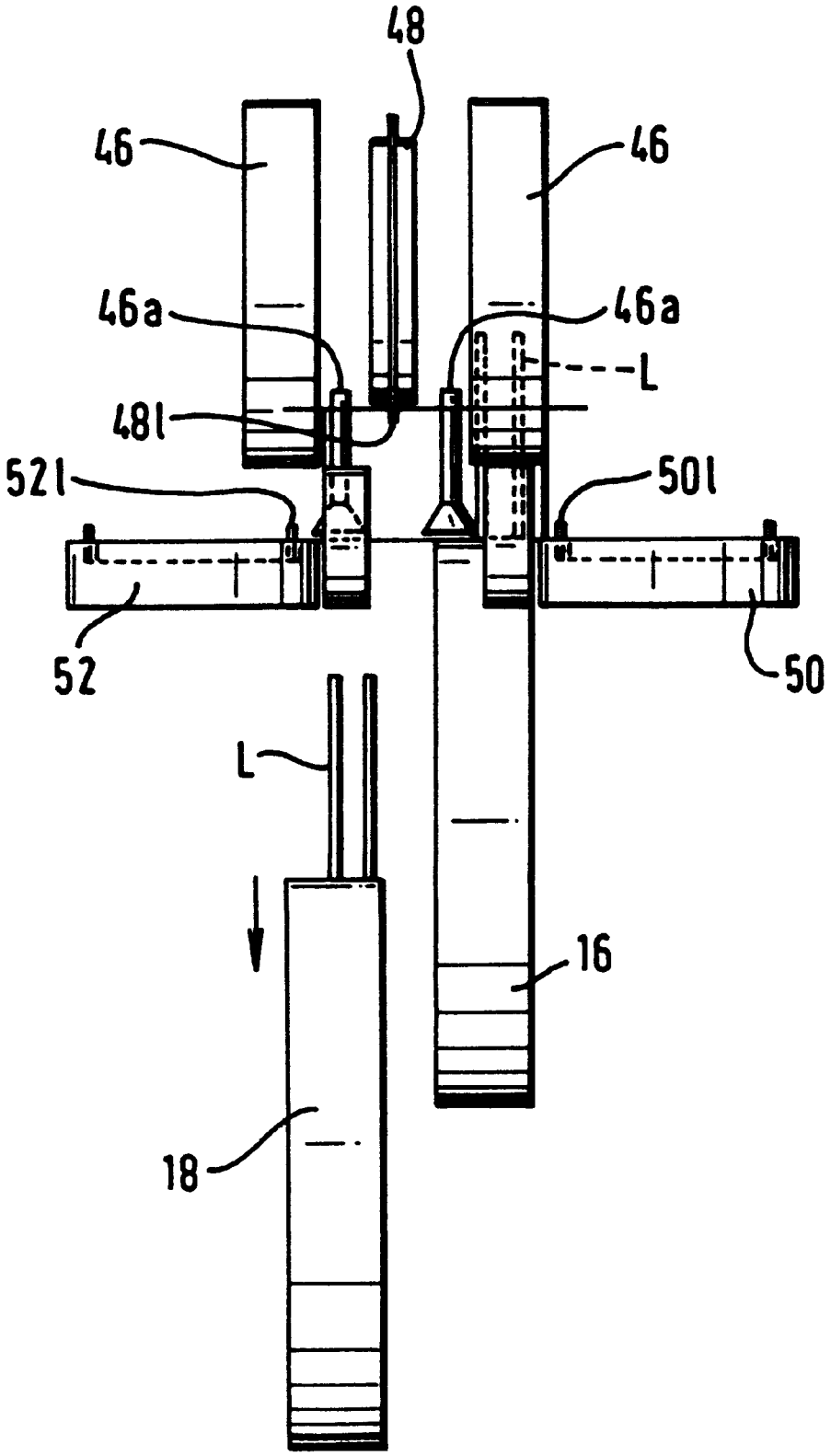
FIG. 15 is a schematic end view of the machine showing only one of the main lug chain assemblies in an operative position.

Thus, with reference to FIGS. 13 and 14, lug chain assemblies 16, 18 are shown in FIG. 13 at the maximum spacing apart for supporting and conveying larger sized cartons. Lug chain assembly 18 is moved transversely towards and away from lug chain assembly 18 by screw driven slide guides (not shown but which are known per se). In the arrangement shown in FIG. 13, retractable support platforms 70, 72 are provided to give additional support to the underside of a carton 'ct' intermediate the lug chain assemblies 16 and 18. These support platforms are carried by arcuate rods 74, 76 which move in guides 78, 80 and which include a series of teeth which mesh with screw threaded adjustment shafts 82 and 84 respectively. Thus by rotating the adjustment shaft the guide rods can be extended to put the support platforms 70, 72 beneath the carton 'ct' carried by the lug chain assemblies 16 and 18 or retracted along the guides 78, 80 provided in the lug chain assemblies. Normally when the support platforms are in their retracted position as shown in FIG. 14, lug chain assembly 18 will have been adjusted to move inwardly so that it is closely adjacent the fixed lug chain assembly 16. In this configuration the lug chain assemblies are configured to process an intermediate size carton as illustrated in FIG. 14. In some arrangements, where it is required to process small cartons of, say, 2×2 can configurations, the lug chain assembly 18 can be moved to an inoperative position so that the carton is supported and conveyed only by lug chain 16. This general arrangement is shown in FIG. 15 where lug chain assembly 18 is shown in a lowered inoperative position. The lug chain assembly 18 is raised and lowered simply by means of cranks and guides as is well known in the art.

Thus, main lug chain assembly 18 is adjustable both transversely and vertically with respect to lug chain assembly 16 in accordance with the size of package to be processed through the machine. Likewise, as described, the spacing between successive metering bars 'm' is adjustable by removing or adding metering bars to the endless series of carriers provided in the metering bar chain and sprocket assembly 54, 56.

Adjustment of the spacing between adjacent lugs in each main lug chain assembly is also provided as described.

Moreover, at the infeed end of the machine, adjustment of various machine components to accommodate carton blanks of a range of sizes is provided. Thus, the transfer belt assemblies 42, 44 are adjustable transversely relative to one another normally by shifting assembly 44 with respect to assembly 46. If appropriate in relation to carton size only belt assembly 42 may be operative. Likewise, the side lug assemblies 50, 52 are transversely adjustable to the same end normally by shifting side lug assembly 52 relative to assembly 50. The two units of the twin overhead rotary carton opening devices 46 also are adjustable both transversely relative to one another and vertically to account for varying heights of different carton sizes. Likewise, the overhead lug chain assembly 48 is height adjustable for the same reason. The specific mechanisms for effecting such adjustments are not critical and can be put into effect by those skilled in the art.

What is claimed is:

1. A continuous-motion packaging machine for packaging articles into cartons, comprising:

a carton conveyor for conveying the cartons along a conveyor path, said carton conveyor including a first endless series of carton conveying elements and a second endless series of carton conveying elements, means for carrying said first endless series of conveying elements along said conveyor path, and means for carrying said second endless series of conveying elements along said conveyor path;

a first servo motor for driving said means for carrying said first endless series of conveying elements;

a second servo motor for driving said means for carrying said second endless series of conveying elements;

a motor control device for operating said first and second servo motors for synchronous advance of said first and second endless series of conveying elements for advance of cartons along said path, and for relative movement between said first and second endless series of conveying elements for adjustment of the spacing between adjacent ones of said conveying elements in accordance with the size of cartons to be conveyed.

2. A packaging machine as claimed in claim 1, wherein relative movement of said first and second endless series of conveying elements for adjustment of the spacing between adjacent ones of said conveying elements is performed by advancing said first series of conveying elements while holding said second series of conveying elements stationary.

3. A packaging machine as claimed in claim 1, wherein relative movement of said first and second endless series of conveying elements for adjustment of the spacing between adjacent ones of said conveying elements is performed by advancing said first series of conveying elements while moving said second series of conveying elements in a reverse direction.

4. A packaging machine as claimed in claim 1, wherein operation of said first and second endless series of conveying elements for synchronous advance is performed by operating said first and said second servo motors in synchronism.

5. A packaging machine as claimed in claim 1, wherein said means for carrying said first endless series of conveying elements along said conveyor path includes a chain for mounting said first endless series, and said means for carrying said second endless series of conveying elements along said conveyor path includes a chain for mounting said second endless series.

6. A packaging machine as claimed in claim 5, wherein each of said first and second endless series of conveying elements includes a series of upstanding carton lugs.

7. A packaging machine as claimed in claim 1, wherein said means for carrying said first endless series of conveying elements along said conveyor path includes a first pair of chains mounted in parallel, spaced-apart relationship.

8. A packaging machine as claimed in claim 7, wherein said means for carrying said second endless series of conveying elements along said conveyor path includes a second pair of chains mounted in parallel, spaced-apart relationship.

9. A packaging machine for packaging articles into cartons, comprising:

a carton conveyor for conveying the cartons along a conveyor path, said carton conveyor including a first pair of chains mounted to extend along said conveyor path in parallel, spaced-apart relationship, a series of carton conveying elements being mounted to each chain of said first pair, and a second pair of chains mounted to extend along said conveyor path in parallel, spaced-apart relationship, a series of carton conveying elements being mounted to each chain of said second pair;

a first pair of servo motors, one motor of said first pair being connected to each chain of said first pair of chains, for driving said first pair of chains;

a second pair of servo motors, one motor of said second pair being connected to each chain of said second pair of chains, for driving said second pair of chains;

a motor control device for operating said first and second pairs of servo motors for synchronous advance of said first pair of chains and said second pair of chains for advance of cartons along said path, and for relative movement between said first pair of chains and said second pair of chains for adjustment of the spacing between adjacent ones of said conveying elements in accordance with the size of cartons to be conveyed.

* * * * *